United States Patent [19]

Seaman

[11] Patent Number: 4,979,667

[45] Date of Patent: Dec. 25, 1990

[54] PIZZA TRAY AND LID

[75] Inventor: J. Peter Seaman, Summerville, S.C.

[73] Assignee: Westvaco Corporation, New York, N.Y.

[21] Appl. No.: 521,429

[22] Filed: May 10, 1990

[51] Int. Cl.[5] ..... B65D 5/28

[52] U.S. Cl. ..... 229/114; 229/109; 229/125.36; 229/168; 229/178; 229/906

[58] Field of Search ..... 229/109, 114, 125.36, 229/149, 150, 168, 178, 902, 906

[56] References Cited

U.S. PATENT DOCUMENTS

| | | | |
|---|---|---|---|
| 2,056,297 | 10/1936 | Rood | 229/114 |
| 2,483,063 | 9/1949 | Ray | 229/109 |
| 2,705,589 | 4/1955 | Steele | 229/168 |
| 2,751,138 | 6/1956 | Laver | 229/109 |
| 2,875,942 | 3/1959 | Wilson | 229/109 |
| 3,162,350 | 12/1964 | Miller | 229/168 |
| 3,462,065 | 8/1969 | Asman | 229/109 |
| 3,981,431 | 9/1976 | Matsuyama | 229/114 |
| 4,054,241 | 10/1977 | Meyers et al. | 229/109 |
| 4,765,534 | 8/1988 | Zion et al. | 229/109 |

*Primary Examiner*—Gary E. Elkins

[57] ABSTRACT

A package for carryout food such as pizza includes a polygonal shaped tray and a separate lid. The tray is prepared from a single blank of paperboard or the like and includes a generally polygonal shaped bottom panel with integral side wall segments. At least four opposed side wall segments are provided with slotted false interior walls which support and retain the separate lid in place after the food is packaged.

5 Claims, 3 Drawing Sheets

PIZZA TRAY AND LID

BACKGROUND OF INVENTION

Many different types and designs of packages have been developed for packaging food products for carryout. However, these designs often overlook the specific needs for the intended food product. Convenience foods such as pizza, bakery goods and the like, that are sold for carryout use, are traditionally packaged in rectangular paperboard containers. However, even though such food products are often round in shape, the package doesn't exactly fit the food product. U.S. Pat. No. 4,765,534, discloses a substantially square container for packaging pizza wherein the four corners have integral panels which are folded inwardly. However, the container of this patent is of one piece construction and it is not as readily inventoried as the container of the present invention.

SUMMARY OF INVENTION

In its preferred embodiment, the tray comprises a substantially horizontal bottom wall and an outwardly inclined side wall formed from a plurality of independent side wall segments which are foldably attached to the bottom wall. For this purpose, the bottom wall is applied with a plurality of connected, inner score lines which define the generally polygonal shape of the tray. These score lines also form the points of attachment for the separate side wall segments to the bottom wall. The alternating, opposed side wall segments each include a pair of integral, triangularly shaped glue flaps foldably attached to each end thereof along fold lines. The remaining alternating, opposed side wall segments each include extended flap elements foldably attached to the outer edges thereof along fold lines which are parallel to the fold lines connecting the side wall segments to the bottom wall. The extended flap elements are divided into two portions which form respectively, an abbreviated top panel and a false interior wall panel attached to each of the remaining alternating, opposed side walls. Cut outs are provided in these panels to serve as supports for the separate lid element. These panels are held in place when the tray is formed for use by individual tab elements provided along the outer edges of each false wall panel which becomes fictionally engaged in slots provided therefor along the fold lines between each alternating, opposed side wall and the bottom panel.

The trays are partially formed by folding the segmented side walls upwardly to their slightly inclined position where the glue flaps on the first set of alternating, opposed side wall segments are adhered to the ends of the remaining alternating, opposed side wall segments. In this condition, the extended flap elements remain unfolded and attached to the remaining alternating, opposed side wall segments and the partially formed trays can be stacked for storage. In order to prepare the trays for use, the extended flap elements are folded downwardly where the tabs on the ends of the inner false wall panels are locked in slots provided therefor in the base panel. This action converts the cut outs in the false interior wall panels to slots for accepting the separate lid provided for the tray. The lid is formed in a polygonal shape like the polygonal shape of the tray bottom, and includes protrusions at alternate sides to match the remaining alternating side walls of the tray. These protrusions fit into the slots on the false inner walls provided by the cut outs therein to form peripheral supports for the lid. These supports prevent the lid from touching the contents of the tray. While protecting the contents from contamination. Meanwhile the slots also provide vent openings for venting steam and moisture from the food in the tray.

It is to be understood that the glue flaps attached to the ends of each of the first alternating side wall segments are formed by what would normally be excess blank material between the side wall segments. Thus, this material is available for securing the side wall segments together when the tray is formed. The size, dimensions and shape of the glue flaps may be varied depending upon the height of the side walls and the angle of inclination of the side walls with respect to the bottom wall. Since it is not necessary to remove any excess blank material from the glue flap area, cost savings are incurred, and when secured to their adjacent side wall segments the glue flaps produce a rigid and durable structure without multiple thicknesses of blank material. Accordingly, while it is the primary object of the present invention to provide a new and improved pizza tray, it is a further object to provide such a tray that is easier to manufacture and form than the prior art constructions of a similar type.

DETAILED DESCRIPTION

Figure 1:
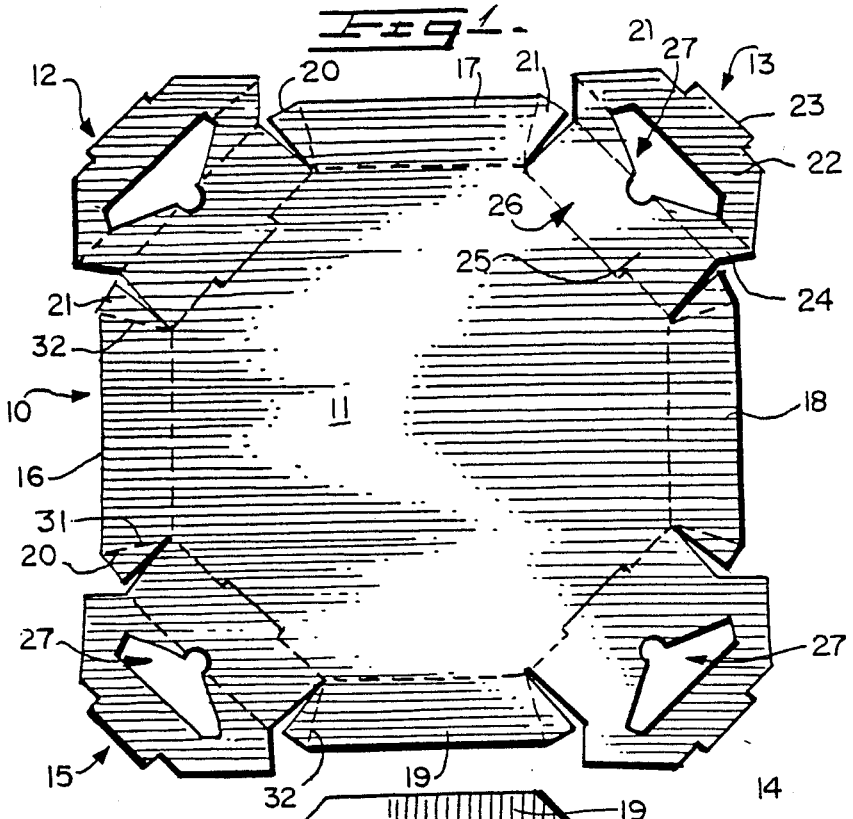
FIG. 1 is a plan view of a paperboard blank that is cut and scored to produce the tray of the present invention.
Figure 2:
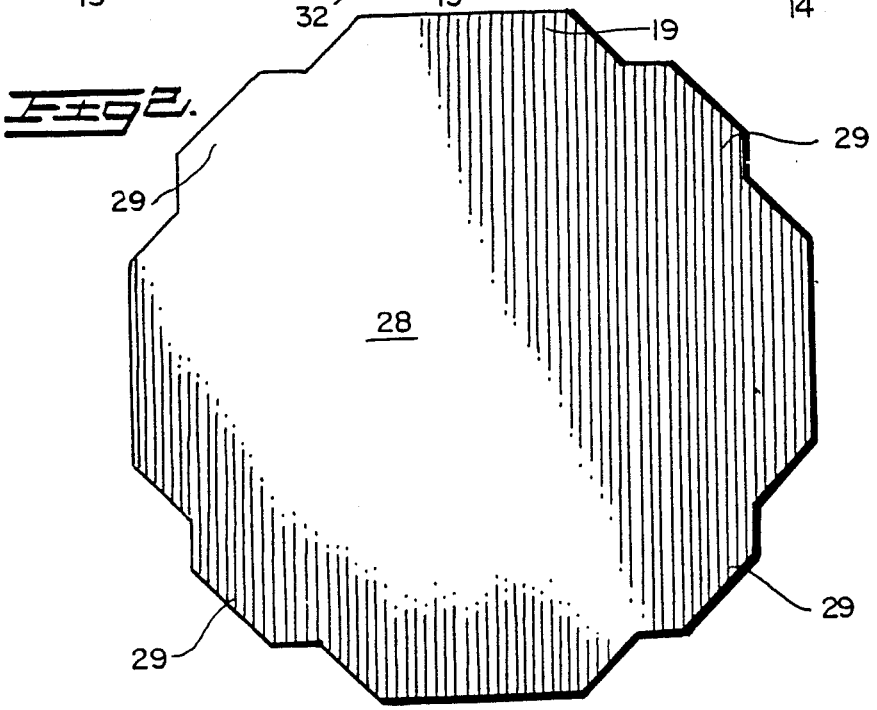
FIG. 2 is a plan view of a paperboard blank for the lid of the present invention.
Figure 3:
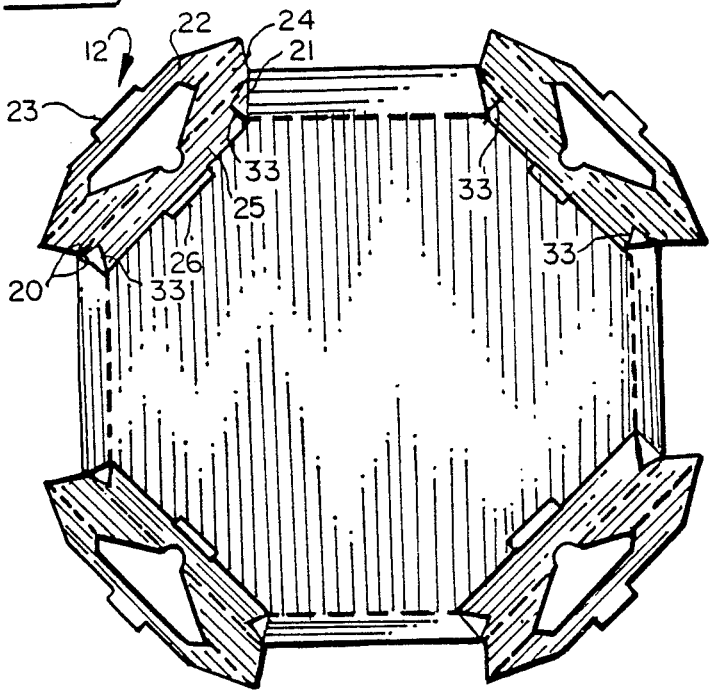
FIG. 3 is a plan view of the tray in a partially assembled condition with side wall segments adhered together.

As shown more particularly in FIG. 1, the tray-like receptacle of the present invention is formed from a single, flat, substantially polygonal shaped blank of bendable material such as paperboard or the like. In its preferred form, the blank is constructed from rigid paperboard which may be coated with a food contact coating or the like on its inside surface. The polygonal outline of the tray is established by the inner score lines 30 which connect the individual side wall segments 16, 17, 18 and 19, and the remaining side wall segments 25, to the base panel 11. The number of side wall segments, and hence, polygonal edges 30 of the blank is not material except that an even number greater than four is desired. In the preferred example eight side wall segments are disclosed. Each of the first side wall segments 16, 17, 18 and 19 are provided with glue flaps 20, 21 foldably attached to the ends thereof along score lines 31, 32. Each glue flap 20 and 21 has a free edge 33 which is cut from the blank material 10. Thus, in order to take up what would normally be excess blank material when the tray is formed, the free edges 33 of the glue flaps 20 and 21 on each side wall segment 16, 17, 18 and 19 are positioned on the inner surfaces of the remaining side wall segments 25 and glued thereto when the tray is partially set up as shown in FIG. 3.

Figure 4:
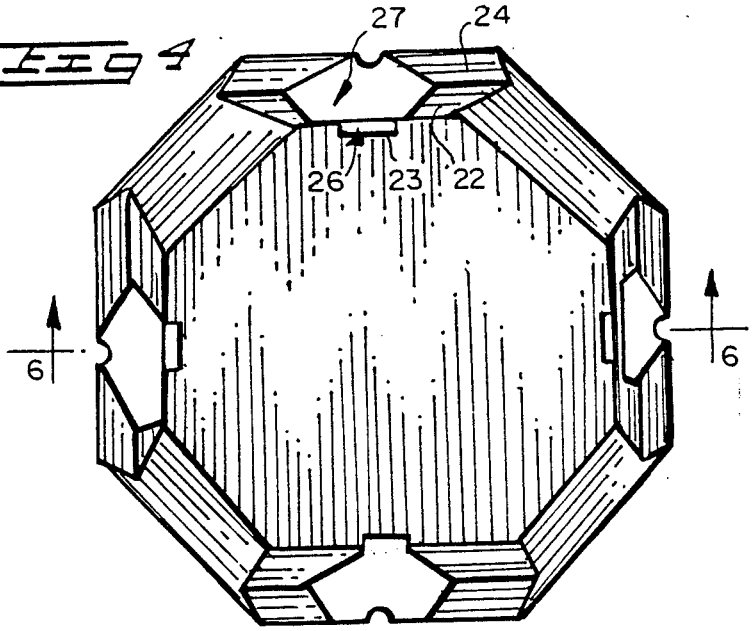
FIG. 4 is a plan view of the fully assembled tray.

Meanwhile, blank 10 also includes a plurality of side wall extensions 12, 13, 14 and 15 attached to the remaining side wall segments 25, which are cut and scored to form false inner side walls for the tray and slots 27 for supporting the separate lid 28. For this purpose, each side wall extension 12, 13, 14 and 15 includes a first portion 24 comprising an abbreviated top panel, foldably attached to side wall segment 25, and a second portion 22 comprising a false inner wall panel, foldably attached to the first portion. The second portion 22 includes a locking tab 23 on the end thereof and a cut out 27 is formed partially in both of portions 22 and 24 to provide slots for the separate lid element 28. The first and second portions 22 and 24 of the side wall extensions 12, 13, 14 and 15 are shaped to match the contours of the polygonal shape of the tray and together form, when folded inside the tray, a false inner wall 22 and abbreviated top panel 24. FIG. 4 illustrates the fully formed tray with four opposed false inner walls 22 and four opposed abbreviated top panels 24. FIG. 4 also illustrates the slots 27 formed in each of the remaining opposed side walls. The side wall flap extensions 12, 13, 14 and 15 remain folded in place as shown in FIG. 4 since the tabs 23 are inserted in the slots 26 provided therefor.

Figure 5:
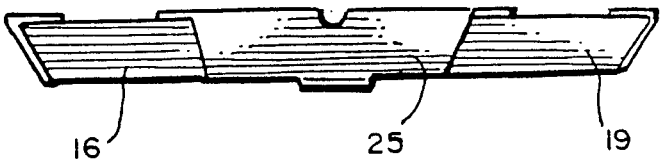
FIG. 5 is a side view of the fully assembled tray.
Figure 6:
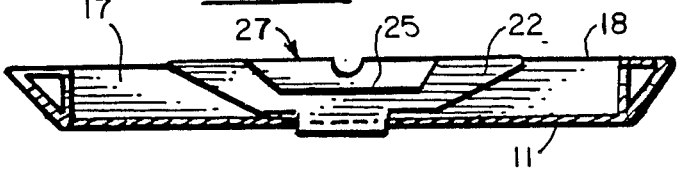
FIG. 6 is a cross sectional view of the fully assembled tray taken along the lines 6—6 of FIG. 4.
Figure 7:
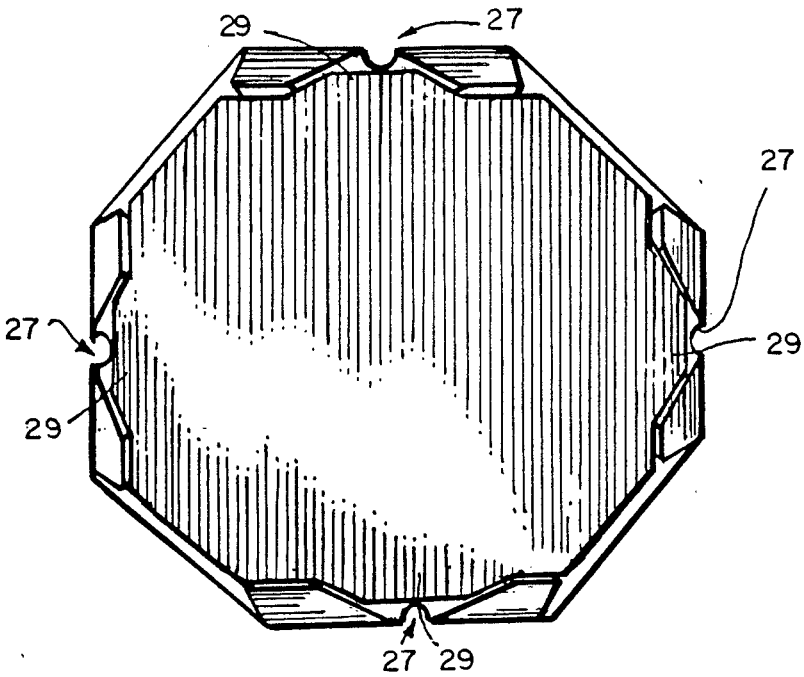
FIG. 7 is a plan view of a combined lid and tray according to the present invention.

FIG. 5 illustrates a typical side view of the tray of FIG. 4 showing side wall segments 16, 25 and 19 and FIG. 6 shows a cross sectional view through the tray illustrating in more detail the shape and orientation of a slot 27 in one of the false side wall segments 22. Finally, FIG. 7 shows the tray with a lid 28 in place. Note that the lid 28 includes integral segments 29 which match precisely the slots 27 in the tray to achieve a good fit.

While the various features of the invention have been disclosed in connection with a tray having eight sides, it will be understood that the tray may have fewer or greater sides provided the number of sides (n) is an equal number greater than four (4). The greater the number of sides, the more nearly round the tray becomes, but that is not a critical factor. The object is to provide a package for a round food product wherein the package is substantially the same shape as the product. Likewise the configuration of the slots in the alternating false walls is not critical. These preferably take a shape that corresponds to the size and shape of the segments provided on the separate lid element.

Thus while the invention has been described and illustrated hereinbefore for one specific embodiment, it is not intended to be strictly limited thereto, and other variations and modifications may be employed within the scope of the claims appended hereto.

What is claimed is:

1. A tray-type food package comprising in combination a tray component and a separate lid component, said tray component comprising a bottom panel, a plurality of side wall segments (n) foldably attached to said bottom wall and extending upwardly therefrom at an included angle greater than ninety degrees, said side wall segments comprising a first group (n/2) that are opposed from one another and which include glue flaps foldably attached to the ends thereof, and a second group (n/2) that are opposed from one another and which include side wall extensions foldably attached to the upper edges thereof, said glue flaps on said first group of side wall segments being adhered to the ends of the side wall segments of said second group, said side wall extensions being folded over toward the inside of the tray to provide a plurality of opposed false walls and abbreviated top panels, and cut outs provided in said false walls and abbreviated top panels to form slots for supporting said lid component.

2. The tray-type food package of claim 1 wherein said tray bottom panel is of generally polygonal shape with (n) edges and each side wall segment is connected to an edge of the polygonal shaped bottom panel along a primary score line.

3. The tray-type food package of claim 2 wherein the lid component is of generally polygonal shape having the same number of edges as said tray component bottom panel and including extensions on (n/2) opposed edges which cooperate with the slots in the false walls of said tray component.

4. The tray-type food package of claim 3 wherein said side wall extensions are divided into two portions by a first fold line, said first portion being attached to the side wall segment by a second fold line and said second segment including a locking tab on the end thereof which is inserted in a locking slot in the tray bottom panel to retain the false side walls and abbreviated top panels in position at opposed sides of said tray.

5. A foldable blank of paperboard material or the like for forming a tray-type food package, said blank being cut and scored to define a centrally located bottom panel of generally polygonal shape having (n) edges, a plurality of side wall segments foldably attached to the bottom panel along primary fold lines at each edge thereof, said side walls being divided into a first group (n/2) which are opposed from one another and which include glue flaps foldably attached to the ends thereof along fold lines, and a second group (n/2) that are opposed from one another, said glue flaps occupying the space between the ends of said side wall segments in said blank material, side wall extensions foldably attached along second score lines to the outer edges of the second group (n/2) of side wall segments, said side wall extensions including two portions divided from one another by a first fold line, a cut out in each of the two portions of each side wall extension, a tab element on the outer edge of each second portion of each side wall extension and a locking slot along the primary score line connecting each side wall of the second group of side wall segments to the bottom panel.

* * * * *